United States Patent [19]

Kuechler

[11] 4,141,342

[45] Feb. 27, 1979

[54] APPARATUS FOR EXTRACTING GREASE AND SMOKE, AND METHOD AND APPARATUS FOR INSTALLING THE SAME

[75] Inventor: Irvin R. Kuechler, San Bernardino, Calif.

[73] Assignee: Vent-Cair, Inc., San Bernardino, Calif.

[21] Appl. No.: 843,709

[22] Filed: Oct. 20, 1977

Related U.S. Application Data

[62] Division of Ser. No. 607,283, Aug. 25, 1975, Pat. No. 4,056,877, which is a division of Ser. No. 509,555, Sep. 26, 1974, Pat. No. 3,952,640.

[51] Int. Cl.[2] ..... F24C 15/20

[52] U.S. Cl. ..... 126/299 D; 98/115 R

[58] Field of Search ..... 98/115 R, 115 SB; 126/299 D; 55/435

[56] References Cited

U.S. PATENT DOCUMENTS

| | | | |
|---|---|---|---|
| 1,131,192 | 3/1915 | White | 104/52 |
| 2,082,374 | 6/1937 | Angus | 98/115 R X |
| 3,285,154 | 11/1966 | De Rosa | 55/DIG. 36 |
| 3,393,497 | 7/1968 | Donnelly | 98/115 R X |
| 3,432,911 | 3/1969 | Rodgers | 29/464 |
| 3,566,585 | 3/1971 | Voloshen | 55/435 |
| 3,631,791 | 1/1972 | Harris | 98/115 R |
| 3,664,255 | 5/1972 | Kuechler | 126/299 D |
| 3,897,046 | 7/1975 | De Weese | 98/115 R |
| 3,999,471 | 12/1976 | Bishop | 98/115 R X |
| 4,085,736 | 4/1978 | Kuechler | 126/299 D |

FOREIGN PATENT DOCUMENTS

| | | | |
|---|---|---|---|
| 1180852 | 2/1970 | United Kingdom | 98/115 K |

*Primary Examiner*—Nile C. Byers, Jr.

[57] ABSTRACT

A grease hood and plenum apparatus is mounted at the ceiling of a restaurant kitchen, and incorporates grease filters and also means to direct make-up air toward such filters. The make-up air passes through a capture chamber the bottom of which is open for reception of fumes from a cooking appliance disposed in the kitchen. An extended exhaust plenum chamber projects upwardly from the hood to draw air and fumes through the filters, and a supply means extends upwardly from the hood to supply make-up air thereto. Blower means deliver make-up air to the supply means and also draw air and fumes from the extended exhaust plenum. The kitchen ceiling has an opening or hole sized and shaped to receive downwardly the grease hood in premanufactured condition, and means are provided to support the greaee hood at the opening and at least partially below the level of the ceiling so that fumes may pass upwardly into the capture chamber.

In accordance with the method, the unitary smokehood and plenum construction is substantially completed at the factory and then is easily and unitarily installed at the job site by dropping it into the hole or opening in the kitchen ceiling or roof. The hood is supported in spaced relationship above a cooking appliance in the kitchen, and the hole is closed to prevent ingress of water.

20 Claims, 16 Drawing Figures

APPARATUS FOR EXTRACTING GREASE AND SMOKE, AND METHOD AND APPARATUS FOR INSTALLING THE SAME

CROSS REFERENCE TO RELATED APPLICATIONS

This application is a division of my copending patent application Ser. No. 607,283, filed Aug. 25, 1975, now U.S. Pat. No. 4,056,877 for Apparatus for Extracting Grease and Smoke, and Method and Apparatus for Installing the Same, which is, in turn, a division of application Ser. No. 509,555, filed Sept. 26, 1974, now U.S. Pat. No. 3,952,640 for Apparatus and Method for Extracting Grease and Smoke, and Method of Installing the Same.

BACKGROUND OF THE INVENTION

1. Field of the Invention

This invention relates to the field of smoke hoods for removing grease and smoke from the spaces above cooking appliances, particularly in restaurants, and to a method and apparatus for installing such hoods.

2. Description of Prior Art

Prior-art reference is hereby made to my U.S. Pat. No. 3,664,255, issued May 23, 1972, for an Apparatus and Method for Removing Fumes from the Space Above a Cooking Appliance, and also to U.S. Pat. No. 3,566,585, issued Mar. 2, 1971, for a Grease-Extracting Apparatus, inventors Mona A. Voloshen and Danny B. Deavor. Elements of these patents form elements of certain embodiments set forth below.

The installing of the hood has always (insofar as applicant is aware) been a multi-step operation. The hood was first manufactured at a factory, then moved into the restaurant through a hole in a side wall (which hole must later be filled). Then the hood was lifted up toward the ceiling, and local (highly expensive) sheet-metal men installed and connected the blowers and ducts. In the case of extended-plenum apparatus, such local fabrication and/or installation of the plenums proved to be a major problem since it tended to be done incorrectly. After installation, it was necessary to perform testing and make adjustments. It is therefore of major importance that the entire apparatus (including extended plenums) be fully manufactured and fully tested at the factory, then installed at the restaurant with no necessity for local sheet-metal workers or for a hole in the restaurant side wall.

SUMMARY OF THE INVENTION

To vastly reduce costs, mistakes, installation time, etc., the entire apparatus is manufactured and pretested at the factory, then dropped into place at the restaurant through a hole in the roof. Part of the apparatus extends downwardly from the hole, and part extends upwardly therefrom. The hole is then closed around the apparatus, to prevent ingress of water into the restaurant.

DETAILED DESCRIPTION OF THE PREFERRED EMBODIMENT

The entire disclosure of said U.S. Pat. No. 3,664,255 is hereby specifically incorporated by reference into the present application, as if set forth in full herein, with the following exceptions: (a) elements 43, FIG. 4 of said patent, are replaced by the extended exhaust or plenum chamber shown in FIG. 5 of the present drawings, (b) grease filters 20 of said patent are replaced by grease filters 3*a* (FIGS. 5 and 6 of the present drawings). The disclosure of said U.S. Pat. No. 3,664,255 is preferably modified as set forth in my copending patent application Ser. No. 497,690, filed Aug. 15, 1974, for an Apparatus for Removing Fumes from the Space Above a Cooking Appliance in a Restaurant. Such patent application Ser. No. 497,690 is also hereby incorporated by reference herein, as though set forth in full.

The disclosure of said U.S. Pat. No. 3,566,585 relating to the construction of each individual filter 3*a* is hereby specifically incorporated by reference into the present application, as if set forth in full herein. Said filters are numbered 3*a* in the present application, and are preferably operated in the open mode (FIG. 4 of said patent) not the closed mode (FIG. 5 thereof). The degree of opening (i.e., the setting) is therefore uniform across the entire width of the apparatus, being based upon filtering efficiency.

Figure 4:
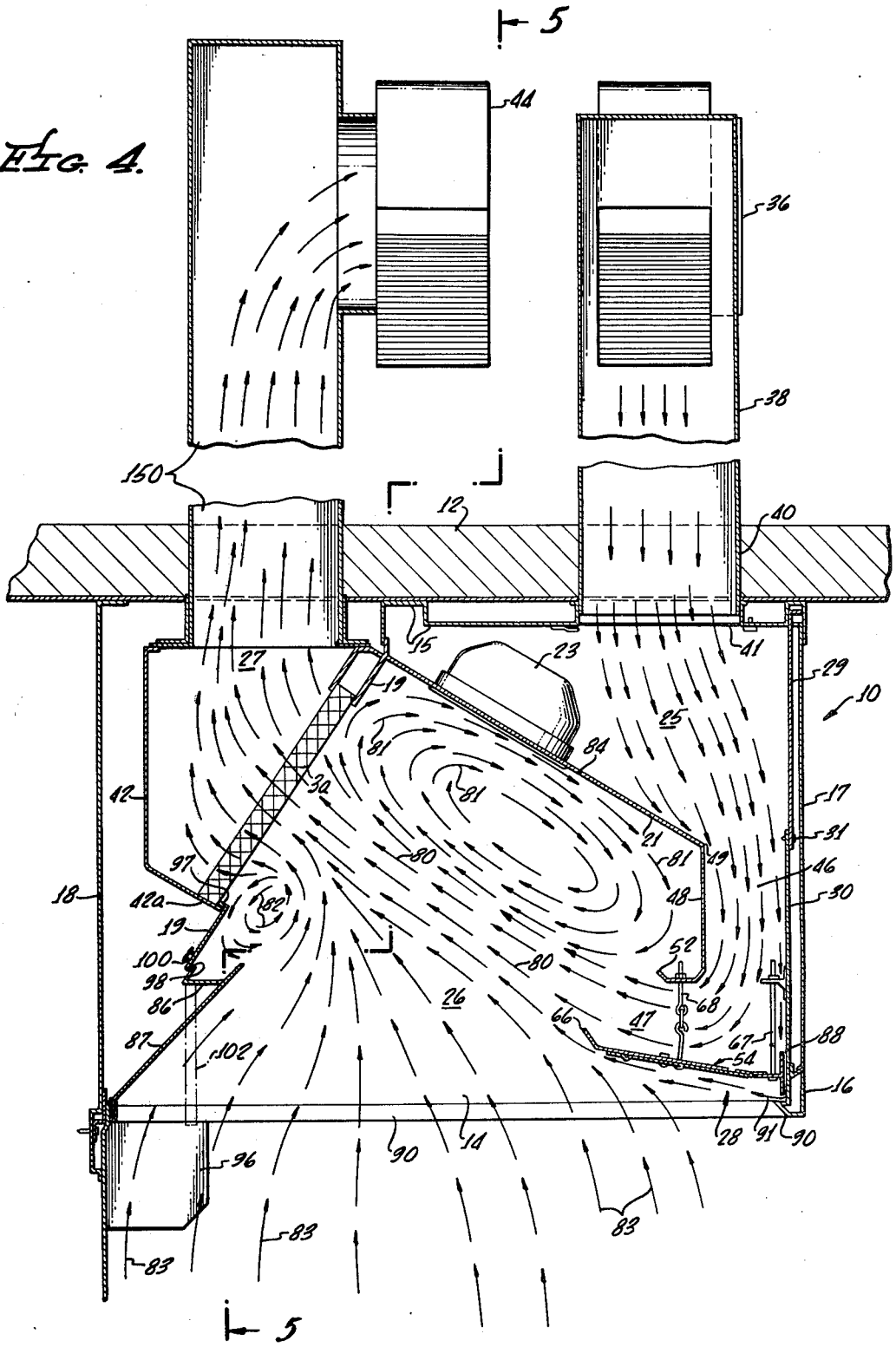
FIG. 4 is a vertical sectional view of smoke hood apparatus, the grease filters being shown schematically, said figure corresponding substantially to FIG. 2 of U.S. Pat. No. 3,664,255.
Figure 5:
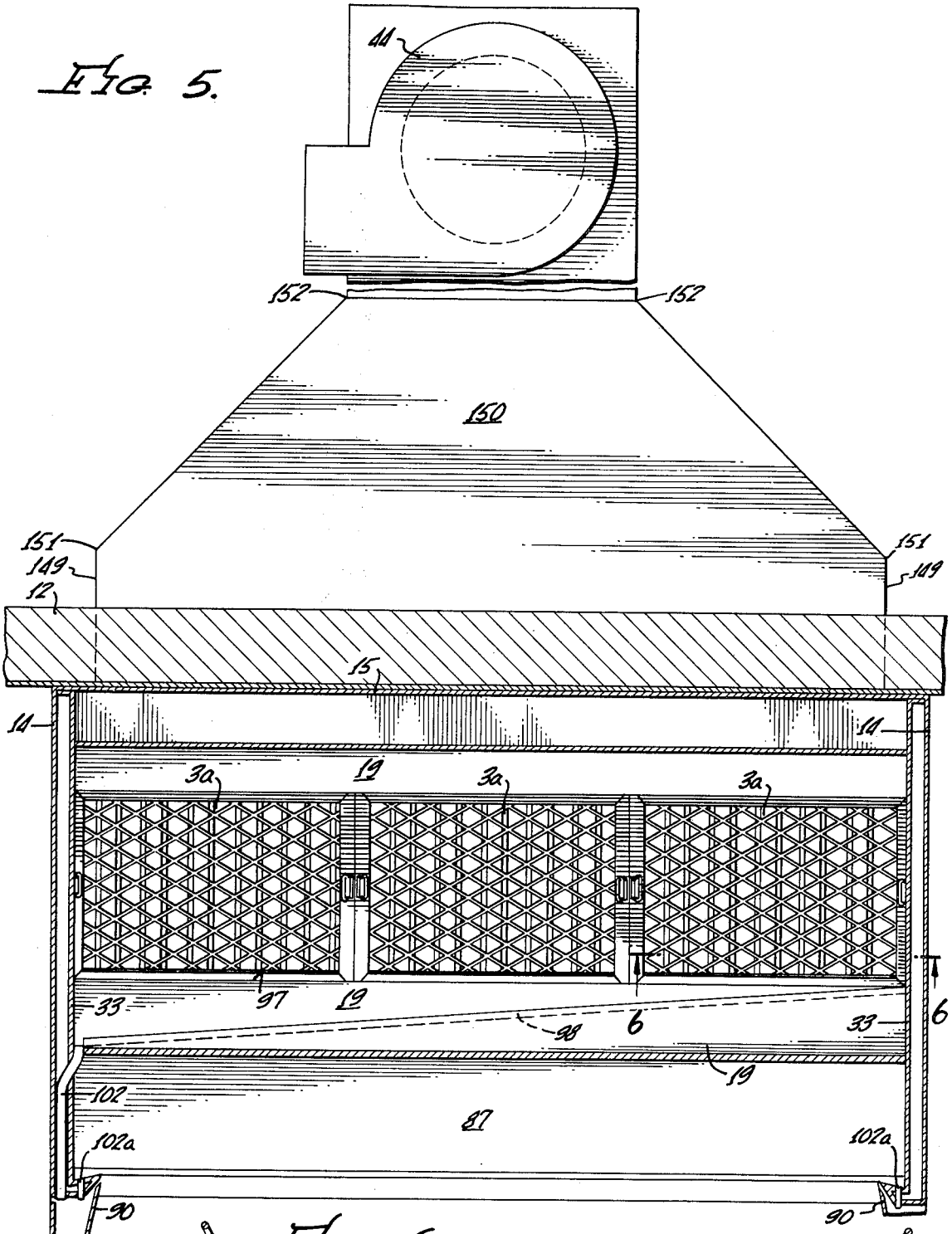
FIG. 5 is a vertical sectional view on line 5—5 of FIG. 4.
Figure 6:
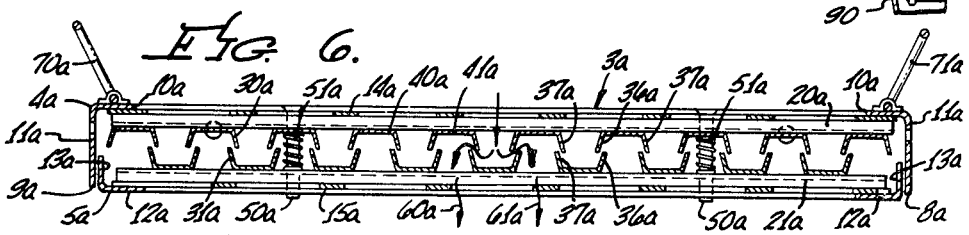
FIG. 6 is an enlarged horizontal sectional view on line 6—6 of FIG. 5, and corresponding substantially to FIG. 4 of U.S. Pat. No. 3,566,585, each number of FIG. 6 being followed by the letter "a."

Referring to FIGS. 4 and 5 of the drawings of the present application, the "exhaust chamber" or plenum chamber 27 does not communicate with exhaust ducts or conduits (numbered 43 in U.S. Pat. No. 3,664,255), but instead communicates with an exhaust or plenum chamber extension 150 which passes upwardly through ceiling 12. Together, the exhaust or plenum chamber 27 and the plenum extension 150 form a greatly extended exhaust or plenum chamber, which may be referred to as an extended plenum chamber. The forward and rear walls of the illustrated plenum extension 150 are vertical, and the lower side wall portions 149 (FIG. 5) of such extension are also vertical. A large part of the lower wall portion of the exhaust or plenum chamber 27 is formed by filters 3*a*.

Above the lower side wall portions 149 are disposed upwardly converging or inclined side wall portions, shown in FIG. 5. Each of these converging portions extends from a lower edge 151 to an upper edge 152, the latter edges being relatively adjacent the intake to exhaust blower 44. The extended exhaust or plenum chamber 27–150 extends upwardly sufficiently far to achieve a uniform air flow across substantially the entire width of the smoke hood. The plenum extension 150 is open at its bottom, communicating with the exhaust or plenum chamber 27 across substantially the entire width of the apparatus. Wall portions 149 should not be indented inwardly more than a few inches (for example, 4 or 5 inches) from inner panel portions 33 (see FIG. 5).

The vertical dimensions of lower side wall portions 149, and/or the convergence of the inclined side wall portions, are related to the width of the smoke hood (the "width" being the horizontal distance between inner panel portions 33, as seen in FIG. 5). Where such width is great, for example 15 to 20 feet, the vertical dimensions of wall portions 149 are made relatively large, and/or the inclined side wall portions (between edges 151–152) are made quite converging. Where such width is less great, for example 5 to 10 feet, the vertical dimensions of wall portions 149 can be small or even zero, and/or the converging side wall portions can be more nearly parallel.

In a typical installation, each edge 151 is at least two feet above the upper edges of filters 3*a*. Thus, the vertical dimension of each lower vertical side wall portion 149 is at least two feet minus the vertical distance from the bottom edge of wall 149 to the upper edges of filters 3*a*. Also, in a typical installation, the angle of convergence of each inclined side wall portion (between edges 151–152) is no more than 45° from the vertical.

EMBODIMENT OF FIGS. 1–3 (NOT INCLUDING INSTALLATION APPARATUS AND METHOD)

Figure 1:
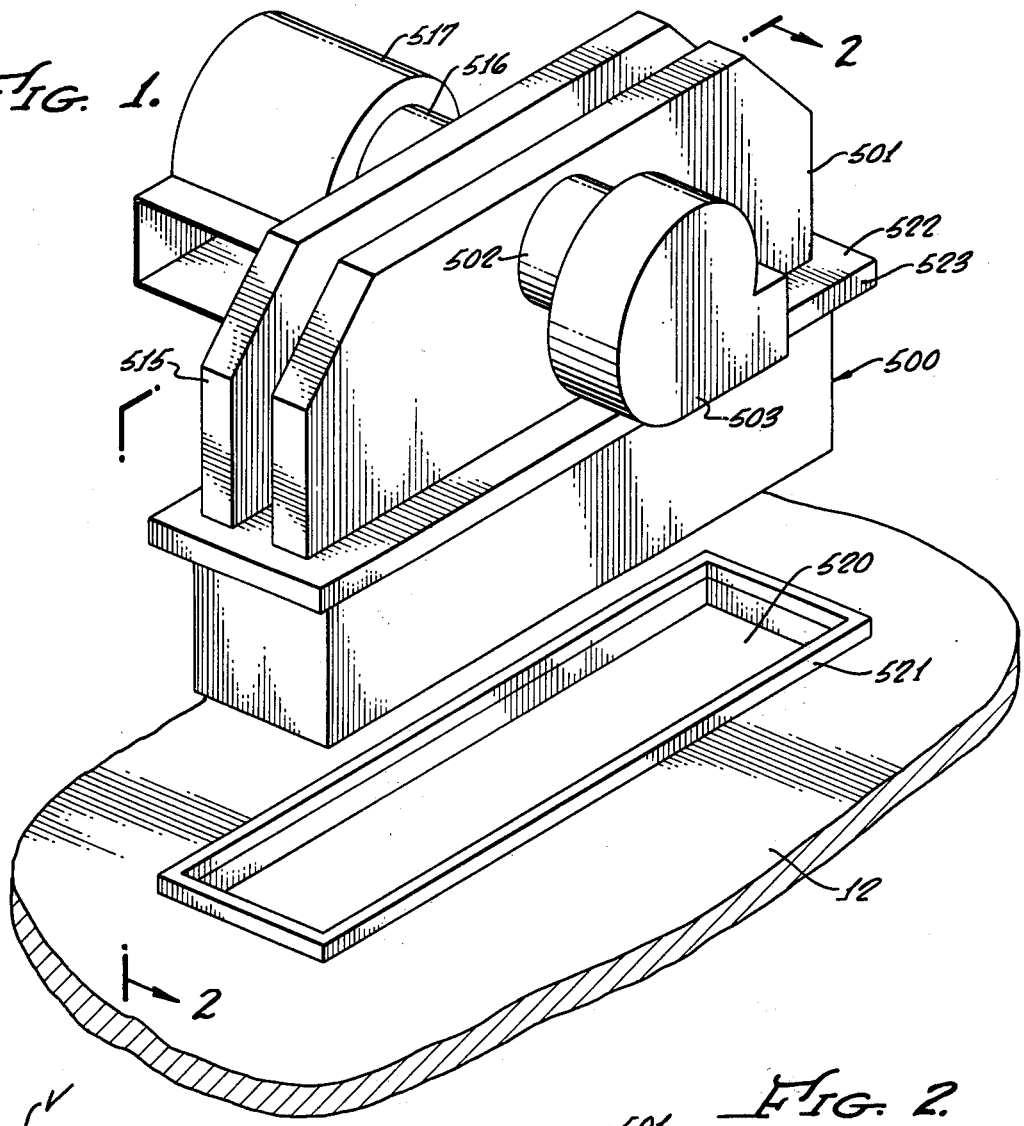
FIG. 1 is an isometric view illustrating a fully factory-constructed and factory-tested unitary smoke hood and extended-plenum apparatus, in upright condition and in the act of being dropped (translated vertically) part way through a predetermined opening in the roof or ceiling of a restaurant kitchen.
Figure 2:
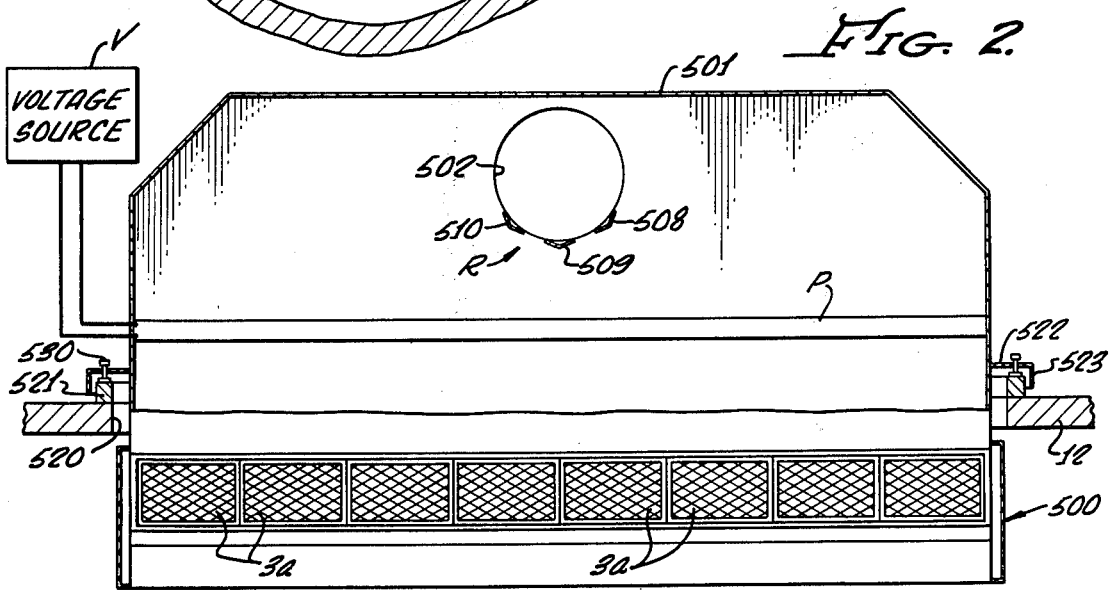
FIG. 2 is a vertical sectional view on line 2—2 of FIG. 1, after installation and leveling have been completed.
Figure 3:
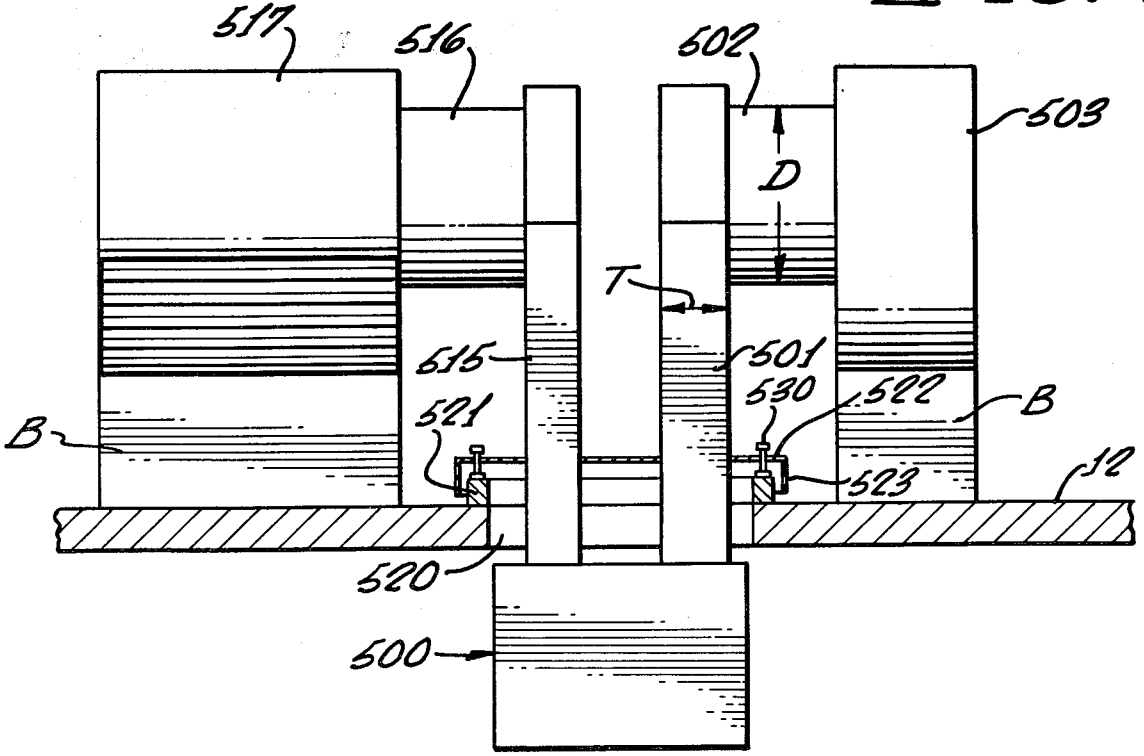
FIG. 3 is a side elevation of the apparatus of FIGS. 1 and 2, the roof or ceiling (and the combination support means and cover) being shown in section.

The embodiment of FIGS. 1–3 solves a major problem. With such embodiment, applicant is for the first time given full control over the entire design and construction, there being no necessity for relying upon local sheet-metal fabricators (who may not follow applicant's specifications, thus causing the entire apparatus to malfunction). With the embodiment of FIGS. 1–3, applicant can prebuild and pretest everything at the factory. The apparatus can then be rapidly installed by relatively unskilled personnel at the job site. The installation apparatus and method of FIGS. 1–3, which are described below, may also be employed with other embodiments of the present invention.

Referring first to FIG. 1, there is shown an extremely large smoke or grease hood 500 of the type described in the above-cited U.S. Pat. No. 3,664,255, as modified in accordance with the above-cited application Ser. No. 497,690. Such apparatus may be, for example, about 20 feet "wide" (distance from left to right, FIG. 2).

Connected to hood 500 at the factory, and extending upwardly therefrom, is an exhaust plenum extension 501. Such extension 501 is much less tall, considering the great "width" of the apparatus, than would be expected. For example, and although the apparatus is (for example) about 20 feet "wide," the plenum extension 501 need only extend about 6 or 7 feet above ceiling 12 when the apparatus is fully installed as shown in FIG. 2. Fabrication and materials costs and problems associated with the extended plenum are, with the present embodiment, reduced.

The plenum extension 501 need not be tall, despite the great "width" of the apparatus, because there is provided a means R (FIG. 2) to restrict or deflect flow to the exhaust duct 502 from the central regions of the exhaust chamber 27 (FIG. 4). Means R reduces flow velocity through the central ones of filters 3*a*. The "central regions" refer to the regions of exhaust chamber 27 which are substantially directly below the duct 502 connecting to exhaust blower 503 (FIGS. 1 and 3). Such restrictor means R are provided relatively adjacent the duct 502, and therefore can be small and self-draining so that only a minimal maintenance problem (if any) is presented.

Another reason why the plenum need not be tall, despite the great "width" of the apparatus, is that the diameter of duct 502 is very large in comparison to the thickness or depth of the plenum extension 501. Referring to FIG. 3, for example, it will be noted that the diameter "D" of exhaust duct 502 is much larger than the thickness "T" of plenum extension 501. Because of this relationship, air and fumes drawn into duct 502 must enter it from all regions of plenum extension 501, not merely (for example) from the plenum extension regions directly beneath the duct.

As an example, in the above-mentioned exemplary construction wherein the apparatus is about 20 feet "wide," dimension "D" may be 30 inches and dimension "T" may be about one foot. (It is to be understood that the lower part of the plenum extension 501 communicates freely with the full horizontal length of exhaust chamber 27 of the smoke hood apparatus, much as is shown and described relative to FIGS. 4 and 5 in connection with plenum extension 150.)

The restrictor means R of FIG. 2 are illustrated to comprise three small baffles or deflectors 508–510 which extend horizontally between the front and rear walls of plenum extension 501. Such baffles 508–510 are disposed generally beneath (and adjacent) the inlet to duct 502, being so shaped and located that the flow of air and fumes through filters 3*a* will be substantially uniform across the entire "width" of the apparatus. The central one 509 of baffles 508–510 is provided with large, unpluggable (by grease) ports or slots for self-draining purposes. Numerous sizes and shapes of restrictor means R may be employed, the exact sizes and shapes being empirically determined. In place of baffles or deflectors, the front wall (for example) of plenum extension 501 may be contoured to provide a constriction below the duct 502, this being a different form of restrictor means R.

The apparatus of FIGS. 1–3 also includes an inlet plenum 515 which connects through a duct 516 to supply blower 517. The diameter of the cylindrical duct 516 is much larger than the thickness of plenum 515. Supply air therefore spreads or "splashes" to all of the upper regions of plenum 515, and then flows down through deflectors which may correspond to deflectors 39 of the above-cited U.S. Pat. No. 3,664,255.

The illustrated unitary and relatively symmetrical apparatus is such that supply blower 517 is disposed on one side of supply plenum 515, whereas exhaust blower 503 is disposed on the remote side of exhaust plenum extension 501. Members 501 and 515 therefore act as baffles, minimizing recirculation of air and fumes through the smoke hood. Furthermore, as shown in FIG. 1, the intake openings of the blowers 502 and 517 are caused to face in opposite directions.

However, as indicated in the above-cited U.S. Pat. No. 3,664,255, at least some recirculation of fume-laden air may be tolerated. This is because the intake air does not enter the kitchen, being instead substantially confined to the hood. When and if such recirculation is desired, a single large blower may be used for both supply and exhaust purposes. A certain proportion of the recirculating air is then vented to the atmosphere. Such single blower (or two blowers) may be located between (or even in) one or both of the supply plenum and the exhaust plenum extension.

It is a major feature of the present apparatus that the filters 3*a* operate very efficiently, particularly since flow therethrough is uniform across the entire width of the apparatus. Such filters therefore remove much grease and "smoke" from the fumes. However, where smog is a particularly acute problem, additional filter means may be provided in the form of the electrostatic precipitator shown at P in FIG. 2.

Such filter (which has many openings therethrough, as well known in the art) extends across the entire thickness and width of the exhaust plenum. It is supplied with high voltage by a voltage source V.

The precipitator P needs only infrequent cleaning because of the highly effective grease removal at regions upstream thereof. When cleaning is needed, it is relatively simple in that the precipitator P may be made up of a number of narrow and relatively short sections which will fit into a commercial dishwasher. It is emphasized that many installations do not require procipitator P.

METHOD AND APPARATUS FOR INSTALLATION

The installation method and apparatus of the invention are described below relative to FIGS. 1–3. They are, additionally, applicable to other embodiments.

The apparatus comprises an opening 520 (FIG. 1) in ceiling or roof 12 and which is sufficiently large to receive (have passed therethrough) the entire fully-assembled smoke hood 500. A support frame 521 is mounted on the upper roof surface, around the periphery of opening 520.

The apparatus additionally comprises a combination support and cover means 522 which is fixedly secured to the smoke hood-plenum apparatus. Member 522 is welded or soldered to the elements 501 and 515, there being openings in member 522 just sufficiently large to snugly receive such elements.

The member 522 is preferably (not necessarily) horizontal and planar, being so located on the elements 501 and 515 that the apparatus 500 will be the desired distance above the cooking appliances when the periphery of member 522 is near rail 521. Heat-insulation means may be incorporated in the member 522.

Member 522 is larger than the framed opening 520. Furthermore, a flange 523 extends downwardly from the periphery of member 522, around the frame 521. Therefore, and since water-tight welded or soldered (or other) joints are made between member 522 and elements 501–515, a weather-tight system is provided as shown in FIGS. 2 and 3.

Suitable heat-insulation and/or water-sealing means, not shown, may be provided inwardly adjacent frame 521.

Suitable leveling screws or bolts (or other means) are provided as shown at 530 in FIGS. 2 and 3, the lower screw ends resting on frame 521. The screws are threaded through the member 522.

In accordance with the method, the entire premanufactured, pretested, and fully operative assembly 500, 501, 515 and 522 is dropped downwardly (vertically translated) so that the hood 500 passes bodily through opening 520. Screws 530 are then employed to effect leveling as well as a fine adjustment relative to elevation. Heat-insulating and/or water-sealing means are then provided inwardly adjacent frame 521.

The blowers 503 and 517 are preferably connected separately at the restaurant, being suitably supported on blocks B as shown in FIG. 3.

The described installation method and apparatus provide, in addition to the major benefits stated above, the additional advantage of reducing the fire danger caused by heat conduction to the roof or ceiling 12. The present invention provides a large space between the plenum extension 501 and the surrounding ceiling 12. This, coupled with the fact that the plenum extension 501 is relatively cool in comparison to the small-area exhaust ducts of the prior art, causes minimized fire danger due to heat conduction. (It is emphasized that diluting the cooking fumes with make-up air, then passing the air and fumes relatively slowly through the ceiling via the large-size plenum extension, causes much less heat to be present near the ceiling than is the case relative to conventional smoke hoods wherein undiluted fumes are concentrated in a small duct and passed at high velocity through the ceiling.) The minimized fire hazard due to heat conduction is added to the major advantage of minimized fire hazard due to grease accumulation.

It is emphasized that the present grease hood apparatus is very "wide," so as to fit over (for example) a row of cooking appliances in a restaurant. The "width" (horizontal dimension, FIG. 2, for example) is much greater than the depth (the front-to-rear dimension as seen in FIG. 3 for example). In many cases, the "width" is at least a plurality of times (and often several times) the depth. Chamber 27 (FIG. 4), and the row of grease filters 3*a* (FIG. 5), are therefore greatly horizontally elongated.

Relative to the installation, FIGS. 1–3, additional or substitute means may be provided to take care of those situations where the architect and/or builder did not construct and/or locate the opening 520 (FIG. 1) with sufficient accuracy. For some such situations, the element 522 is not factory-welded to elements 501 and 515. Instead, element 522 is provided with a single large rectangular opening, sufficiently large to receive both elements 501 and 515 with substantial clearance for lateral and tilting adjustment. The method is then performed without the member 522 in position, and the hood 500 is supported by hangers (incorporating vertical bolts for vertical adjustment) — the hangers being supported on frame 521. Thereafter, the modified element 522 is mounted over the elements 501–515, and flashing and counterflashing are provided at such elements for sealing purposes. Ducts 502 and 516, and blowers 503 and 517, are then connected.

It is pointed out that an important purpose of frame 521 is to act as a dam or dike preventing standing water on roof 12 from leaking through opening 520.

The foregoing detailed description is to be clearly understood as given by way of illustration and example only, the spirit and scope of this invention being limited solely by the appended claims.

I claim:

1. A premanufactured unitary grease hood apparatus at least partially mounted in the roof or ceiling of a restaurant kitchen, which comprises:

(a) a premanufactured unitary grease hood, (b) a ceiling or roof of a restaurant kitchen, said ceiling having a hole therein sufficiently large to have passed downwardly therethrough from the outside of said restaurant kitchen said premanufactured unitary grease hood, and (c) means to support said grease hood at said hole with at least part of said hood disposed below the level of said ceiling, said part of said hood being adapted to receive grease-laden fumes from a cooking appliance disposed therebeneath.

2. The invention as claimed in claim 1, in which said hood is disposed below the level of said ceiling, and in which means extend upwardly from said hood through said hole to conduct fumes away from said hood.

3. The invention as claimed in claim 1, in which means are provided to close said hole to prevent leakage of water through said hole into said kitchen.

4. A premanufactured unitary grease hood apparatus which comprises:

(a) a premanufactured unitary grease hood (b) a roof or ceiling of a restaurant kitchen, said roof having a hole therein sufficiently large to have passed downwardly therethrough from the exterior of said restaurant kitchen, while said grease hood is in upright condition, at least the lower portions of said upright premanufactured unitary grease hood, and (c) means to support said grease hood in an operating position, said grease hood when in said operating position having at least said lower portions thereof disposed below said hole, said lower portions being adapted to receive grease-laden fumes from a cooking appliance disposed therebeneath.

5. The invention as claimed in claim 4, in which said hole is sufficiently large to have all of said hood passed downwardly therethrough when said hood is in upright condition, in which all of said hood is disposed below the level of said roof, and in which means extend upwardly from said hood through said hole to conduct fumes away from said hood.

6. The invention as claimed in claim 5, in which means are provided to close said hole around said fume-conducting means to prevent leakage of water through said hole.

7. A grease hood and plenum apparatus mounted at the ceiling of a restaurant kitchen, which comprises:

(a) a grease hood incorporating grease filters and also incorporating means to direct make-up air toward said grease filters, said make-up air passing through a capture chamber the bottom of which is open for reception of fumes from a cooking appliance disposed therebeneath, (b) an extended exhaust plenum projecting upwardly from said hood to draw air and fumes through said filters, (c) a supply means extending upwardly from said hood to supply said make-up air thereto, (d) blower means to deliver make-up air to said supply means and to draw air and fumes from said extended exhaust plenum, (e) a kitchen ceiling having an opening therein sized and shaped to receive downwardly therethrough said grease hood in premanufactured condition, and (f) means to support said grease hood at said opening and at least partially below the level of said ceiling whereby fumes may pass upwardly into said capture chamber.

8. The invention as claimed in claim 7, in which said grease hood is disposed at an elevation sufficiently low that said extended exhaust plenum and said supply means pass upwardly through said opening.

9. The invention as claimed in claim 8, in which means are provided to close the regions of said opening around said supply means and around said extended exhaust plenum.

10. The invention as claimed in claim 8, in which cover means are provided sealingly around said extended exhaust plenum and around said supply means, said cover means extending outwardly to close said opening.

11. The invention as claimed in claim 10, in which the peripheral portions of said cover means extend over a frame which is provided on said ceiling around said opening.

12. The invention as claimed in claim 11, in which said cover means is supported on said frame, and further functions as said support means recited in clause (f).

13. The invention as claimed in claim 8, in which said opening is sized and shaped to permit said grease hood to be dropped downwardly therethrough while said exhaust plenum and said supply means continue to project and extend upwardly from said hood.

14. The invention as claimed in claim 13, in which said grease hood is disposed at an elevation sufficiently low that said extended exhaust plenum and said supply means pass upwardly through said opening.

15. The invention as claimed in claim 13, in which means are provided to close the regions of said opening around said supply means and around said extended exhaust plenum.

16. The invention as claimed in claim 13, in which cover means are provided sealingly around said extended exhaust plenum and around said supply means, said cover means extending outwardly to close said opening.

17. The invention as claimed in claim 13, in which the peripheral portions of said cover means extend over a frame which is provided on said ceiling around said opening.

18. A premanufactured unitary grease hood apparatus at least partially mounted in the roof or ceiling of a restaurant kitchen, which comprises:

(a) a premanufactured unitary grease hood, (b) a ceiling of a restaurant kitchen, said ceiling having an opening therein sufficiently large to have passed downwardly therethrough said premanufactured unitary grease hood, and (c) means to support said grease hood at said opening with at least part of said hood disposed below the level of said ceiling, said part of said hood being adapted to receive grease-laden fumes from a cooking appliance disposed therebeneath.

19. The invention as claimed in claim 18, in which said hood is disposed below the level of said ceiling, and in which means extend upwardly through said opening to conduct fumes away from said hood.

20. The invention as claimed in claim 18, in which means are provided to close said opening to prevent leakage of water therethrough.

* * * * *